US007832133B2

(12) United States Patent
Chamandy

(10) Patent No.: US 7,832,133 B2
(45) Date of Patent: Nov. 16, 2010

(54) LABELING METHOD, WEB OF LABELS AND LABEL ARRAY

(75) Inventor: Paul A. Chamandy, Ithaca, NY (US)

(73) Assignee: Avery Dennison Corporation, Pasadena, CA (US)

( * ) Notice: Subject to any disclaimer, the term of this patent is extended or adjusted under 35 U.S.C. 154(b) by 284 days.

(21) Appl. No.: 12/011,523

(22) Filed: Jan. 28, 2008

(65) Prior Publication Data

US 2009/0188142 A1 Jul. 30, 2009

(51) Int. Cl.
*G09F 3/18* (2006.01)

(52) U.S. Cl. ..... 40/661.04; 40/675; 40/674

(58) Field of Classification Search ..... 40/661.04, 40/675, 229.01, 674, 638
See application file for complete search history.

(56) References Cited

U.S. PATENT DOCUMENTS 3,212,530 A * 10/1965 Meyer et al. ..... 139/420 R
3,395,470 A * 8/1968 Voice ..... 40/665
4,188,427 A * 2/1980 Grass ..... 428/42.2
5,373,762 A 12/1994 Kato
5,583,489 A 12/1996 Loemker et al.

FOREIGN PATENT DOCUMENTS

DE 2624055 2/1978
WO WO0050239 8/2000

* cited by examiner

*Primary Examiner*—Gary C Hoge

(57) ABSTRACT

There are disclosed several embodiments of label sets or arrays having a substantial capacity for printed information while maintaining all the labels of the array associated and properly oriented with respect to each other, wherein all the labels of each set or array can be printed in a printer. The labels of the array are preferably printed in transverse rows across a label web to increase the number of labels that can be carried on a roll.

22 Claims, 11 Drawing Sheets

LABELING METHOD, WEB OF LABELS AND LABEL ARRAY

CROSS-REFERENCE TO RELATED APPLICATION

Co-owned U.S. patent application Ser. No. 11/789,618, filed Apr. 25, 2007 is made of record.

BACKGROUND

1. Field

The embodiments relate to labeling methods, webs of fabric labels and fabric label arrays.

2. Brief Description of the Prior Art

Prior art is disclosed in connection with FIGS. 31 through 34 of the present application and in the following U.S. Pat. Nos. 5,583,489 and 7,125,182.

Fabric labels applied to garments may carry printed washing and/or dry cleaning instructions, warranty information, country-of-origin, fabric content, size information and the manufacturer's and/or the merchant's logo. Generally, the label is sewn or heat sealed into or onto the garment and the outer side of the label is printed right-side-up and the underside of the label is printed right-side down. If a set of one or more separate labels is intended to be used on a particular garment, there exists the possibility that some of the labels from one set may be interchanged with those of another set and/or that the labels of one set may not be correctly oriented with respect to each other.

SUMMARY

According to the disclosed embodiments, a fabric web of labels is prepared by providing one or more longitudinally extending lines of partial severing to frangibly connect one or more longitudinally extending parallel zones or regions of the web. If desired, the web can also be weakened or partially severed transversely to provide fold lines. The web, usually in roll form, can be loaded into a printer and the desired information can be printed on the outer or upper side of the web and on the underside or lower side of the web. A set or array of connected labels can be severed from the web and can be stacked or otherwise arranged until ready to be used. The connected labels can be folded and attached, for example, sewn or heat sealed onto a garment. Because the labels remain connected even when they are being attached to the garment, there is no possibility that a label from one set can be mismatched with the label of any other set or that the labels can be mis-oriented relative to each other. This use of multiple labels in an array or set or composite on a garment is particularly useful when it is desired to provide the same garment related information on the garment in different languages. Once the label array has been attached to the garment it is a simple matter to break the frangible connection between labels manually when it is desired to read the information on the underside of the outermost label or on an underlying label. Especially the label arrays with three or four labels have substantial information-carrying capacity, and this is valuable in the event the same information is required to be printed in two or more different languages on the same label array. The printing of the same information of, for example, eight languages on eight sides of four connected labels is contemplated.

A specific embodiment of a labeling method comprises some or all of the steps of providing a longitudinally extending web of printable fabric label material having opposite sides or faces and bounded by at least one longitudinally extending frangible line of partial severing spaced between the side edges to provide repetitive sets of at least two labels, and printing information on one face of the web on all or most of the labels of each set and on the other face of the web on at least one of the labels of each set, the labels being capable of undergoing repeated washings and/or dry cleanings, severing the web between along transverse lines between sets to provide two or more printed labels frangibly connected at the partial severing, folding the labels relative to each other to provide a folded label array of at least two frangibly connected, printed labels, attaching the label array to a garment, and separating at least two labels of the array at the partial severing after the array has been attached to the garment.

A specific embodiment of a labeling method comprises some or all of the steps of providing a label array of at least three printed labels connected along at least two frangible lines, the printed labels being capable of undergoing repeated washings and/or dry cleanings, folding the labels along the frangible lines into face-to-face relationship, attaching the printed label array of frangibly connected labels to a garment, and thereafter separating at least some of the labels from each other along the frangible lines.

A specific embodiment of a labeling method comprises some or all of the steps of printing an array of at least two generally planar, frangibly connected, labels in a single printer, folding the labels relative to each other into a folded array, attaching the folded array to a garment and separating the labels from each other along their frangible connection.

In the event a manufacturer or merchant or consumer desires to selectively remove one or more labels of the array in any of the embodiments, the label or labels can be cut off from the array. For example, in the event the array contains four labels with, for example, care instructions in a different language on each side of the label, one or more labels can be cut off to remove two of the languages per label. In another example, a manufacturer may apply one logo to one label and another logo to another label of the array and selectively remove the label carrying the unwanted logo; for example, if a manufacture intends to sell the same product to two different merchants, the manufacturer could apply a different logo to different labels of the array and selectively cut off one label as needed. This will enable the manufacturer to produce or hold a single inventory for both merchants. Even if one or less than all of the labels are cut off, the remaining label or labels could carry the legally required care instructions. If desired, a cut line comprising printing, weaving or perforating to indicate where the label or labels should be cut to avoid damaging the garment can be applied directly to the label or labels adjacent the place where the array is attached to a garment. In addition, a scissor symbol can be applied adjacent the cut to further visually show where the label can be severed from the array, and in this connection reference is made to U.S. Pat. No. 5,583,489. Alternatively, any one or more of the labels could carry a bar code and/or a radio frequency identification (RFID) or electronic article surveillance (EAS) transponder, which could be removed by the merchant or customer by cutting that label from the array, if desired.

BRIEF DESCRIPTION OF THE DIAGRAMMATIC DRAWINGS

Figure 1:
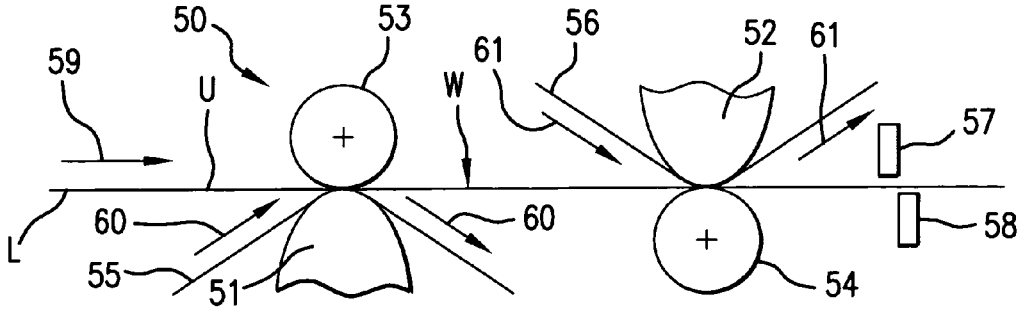
FIG. 1 is a simplified side elevational view of a printer wherein the lower face of a web is being printed by a print head and the upper face of the web is being printed by another print head prior to the web being severed.
Figure 9:
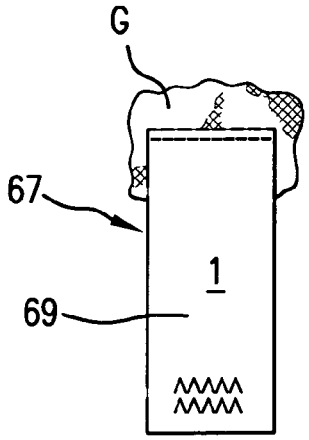
FIG. 9 is a front elevational view of the attached label array shown in FIGS. 7 and 8 for example showing side 1 of the outermost label.
Figure 10:
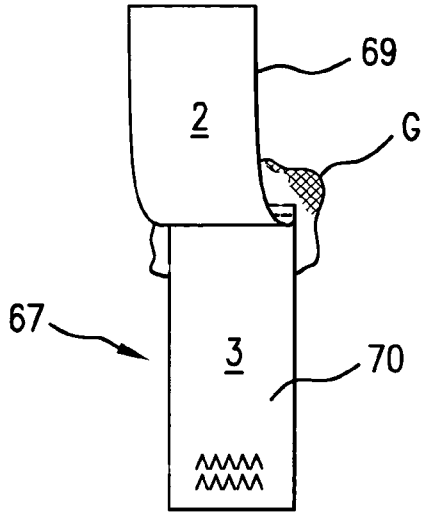
FIG. 10 is a view similar to FIG. 9, but showing the outermost label folded up to expose its side 2 and side 3 of the first underlying label.
Figure 11:
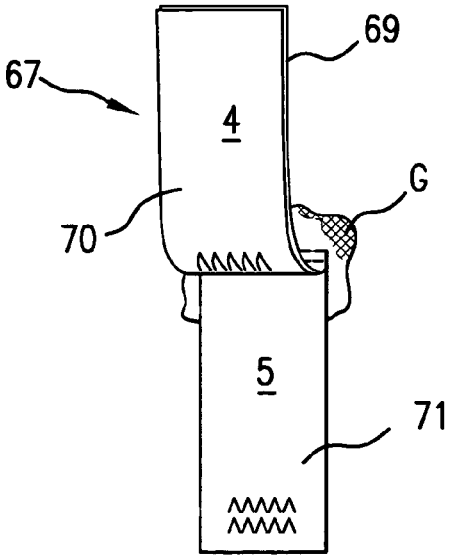
Figure 12:
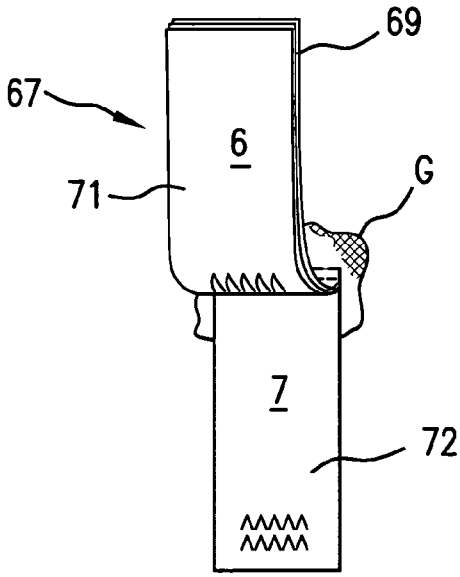
Figure 13:
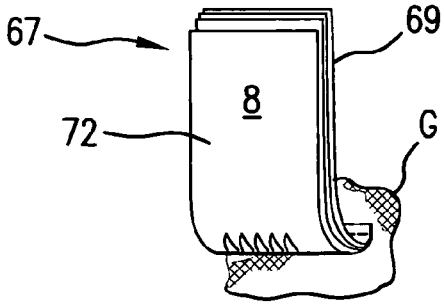
Figure 14:
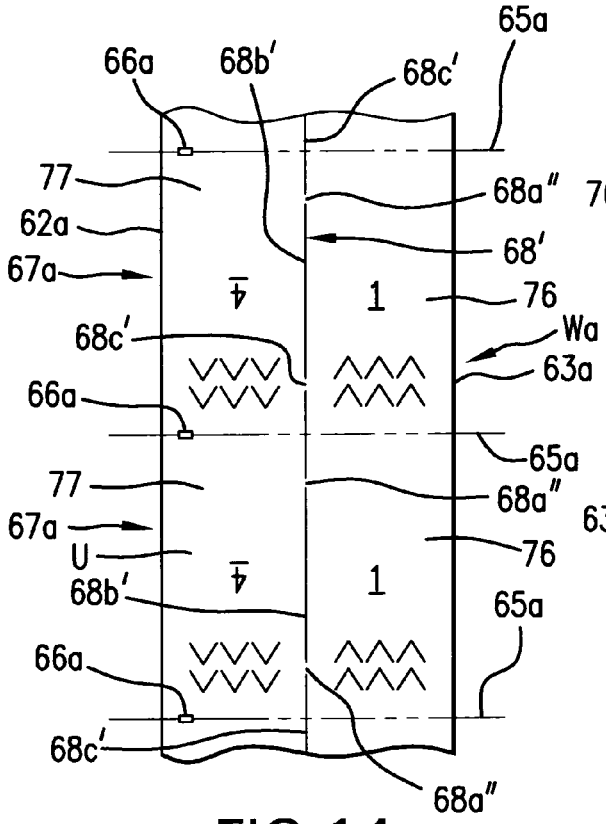
Figure 15:
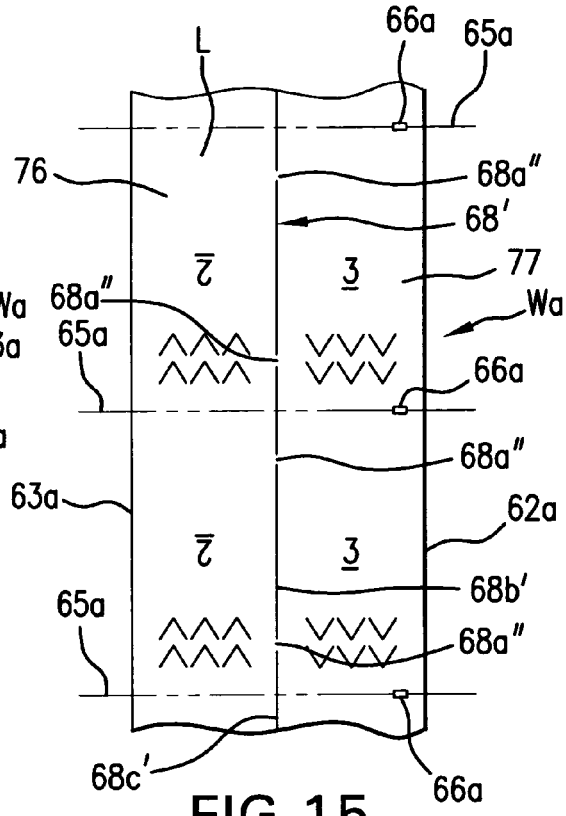
Figure 16:
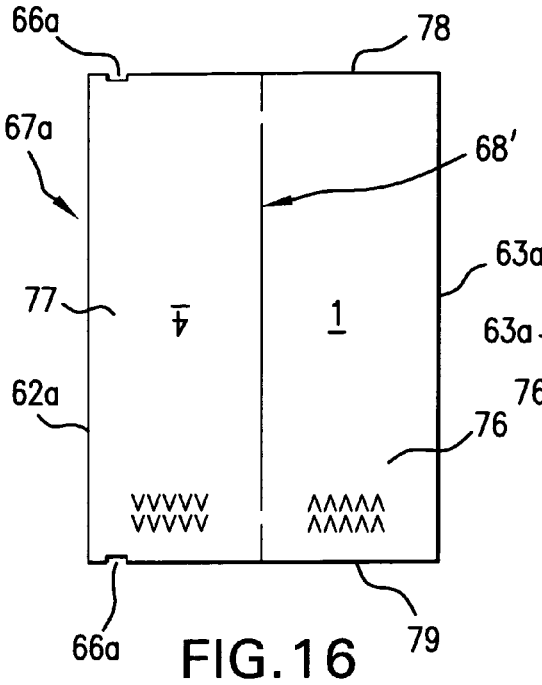
Figure 17:
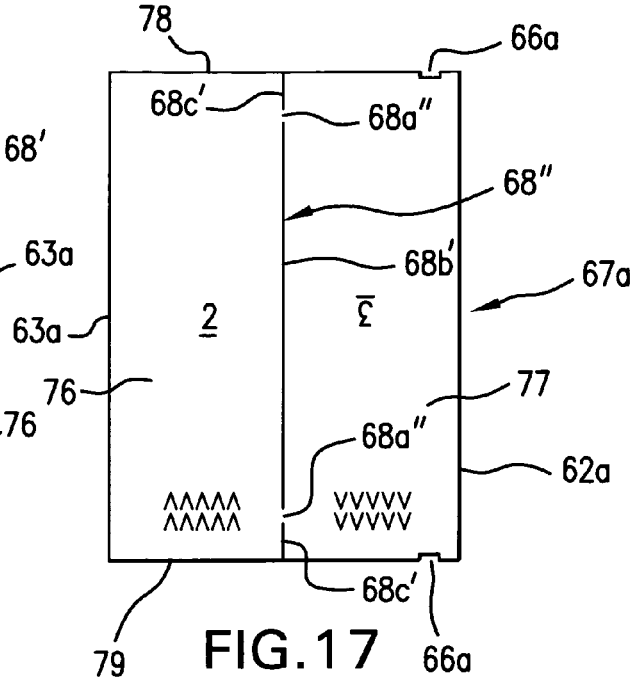
Figure 18:
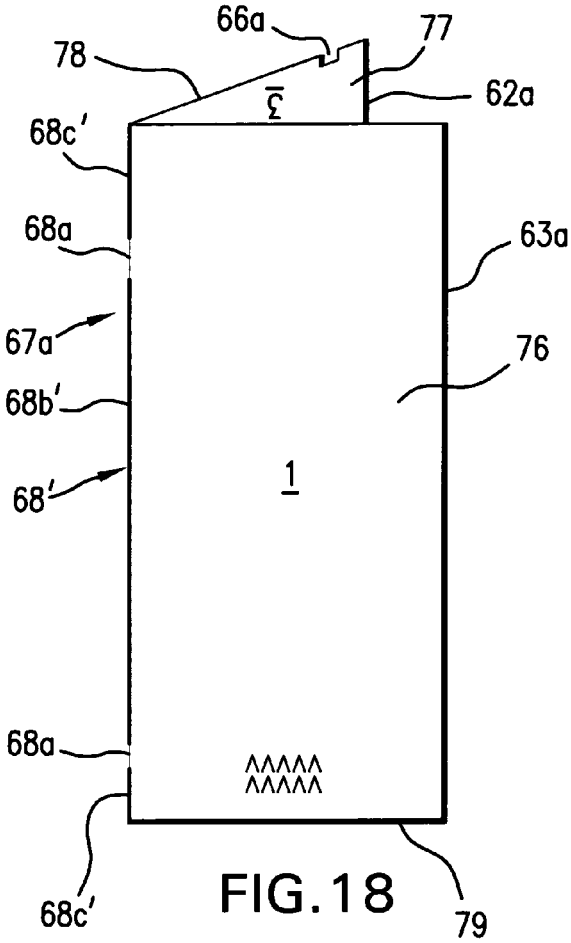
Figure 19:
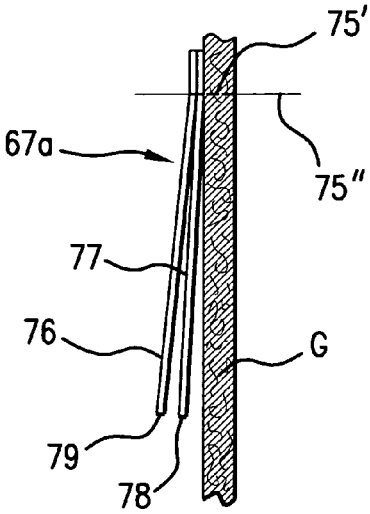
Figure 20:
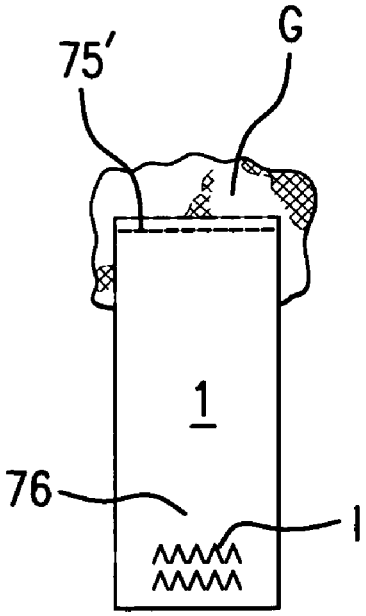
Figure 21:
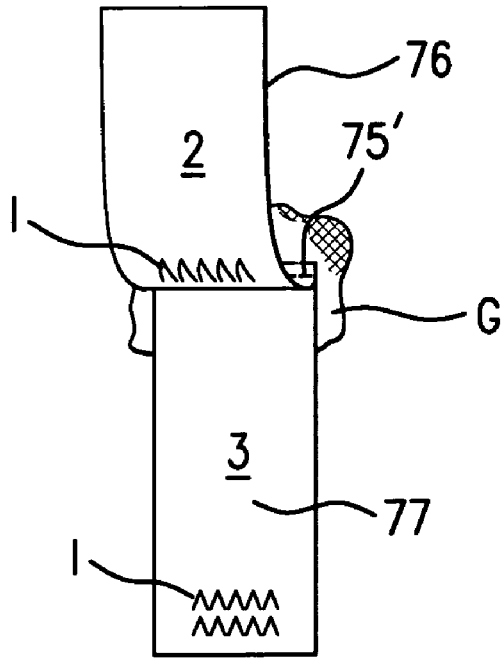
Figure 22:
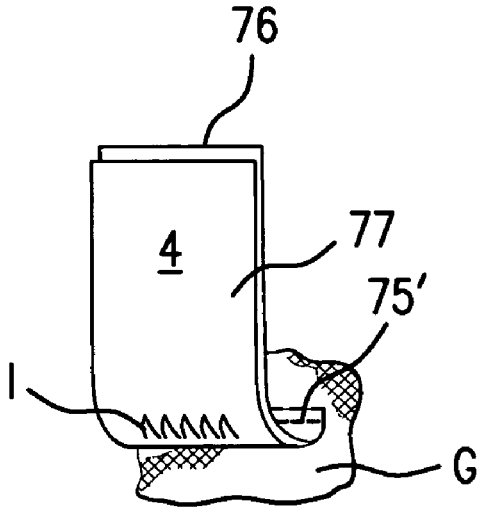
Figure 23:
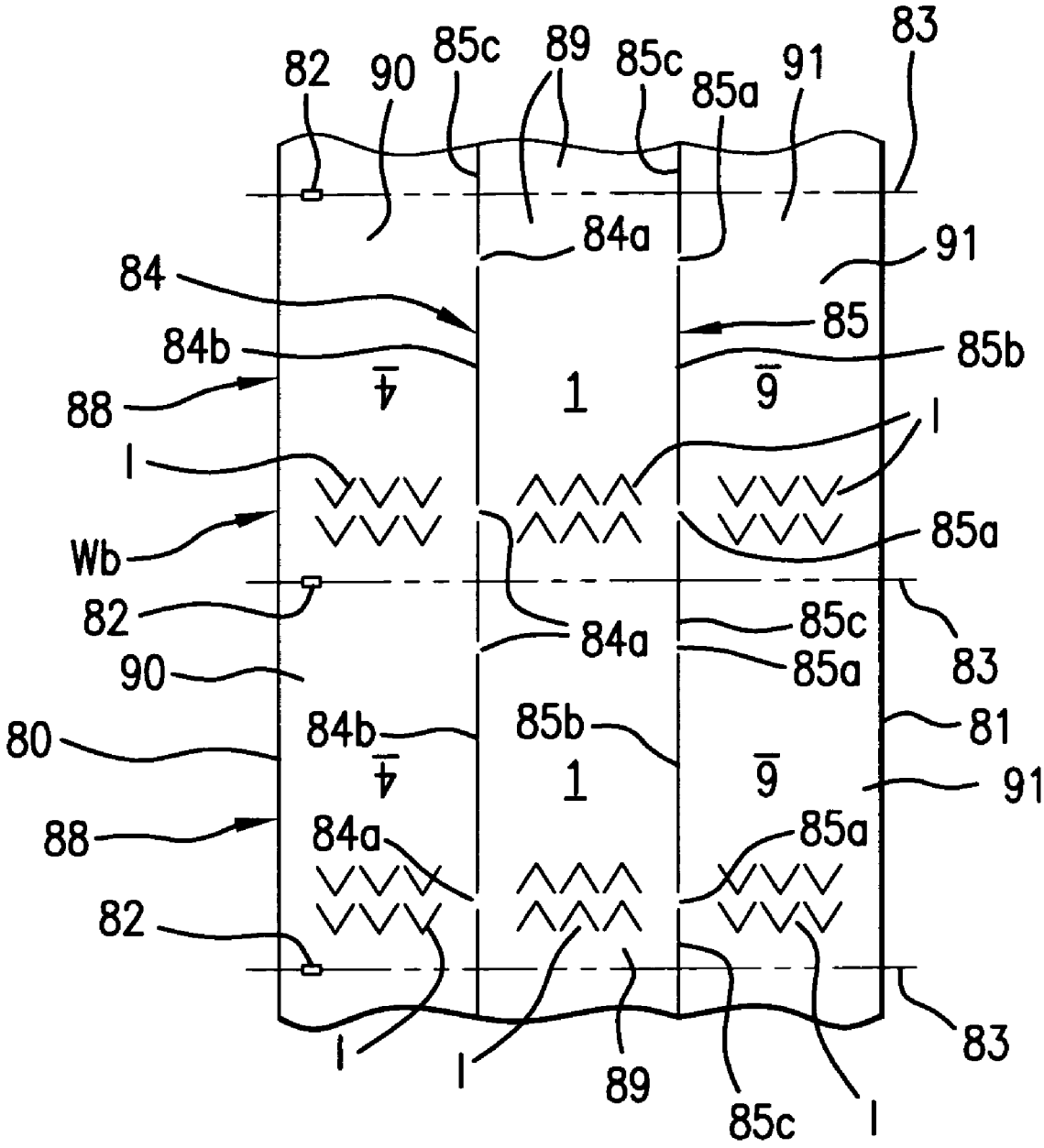
Figure 24:
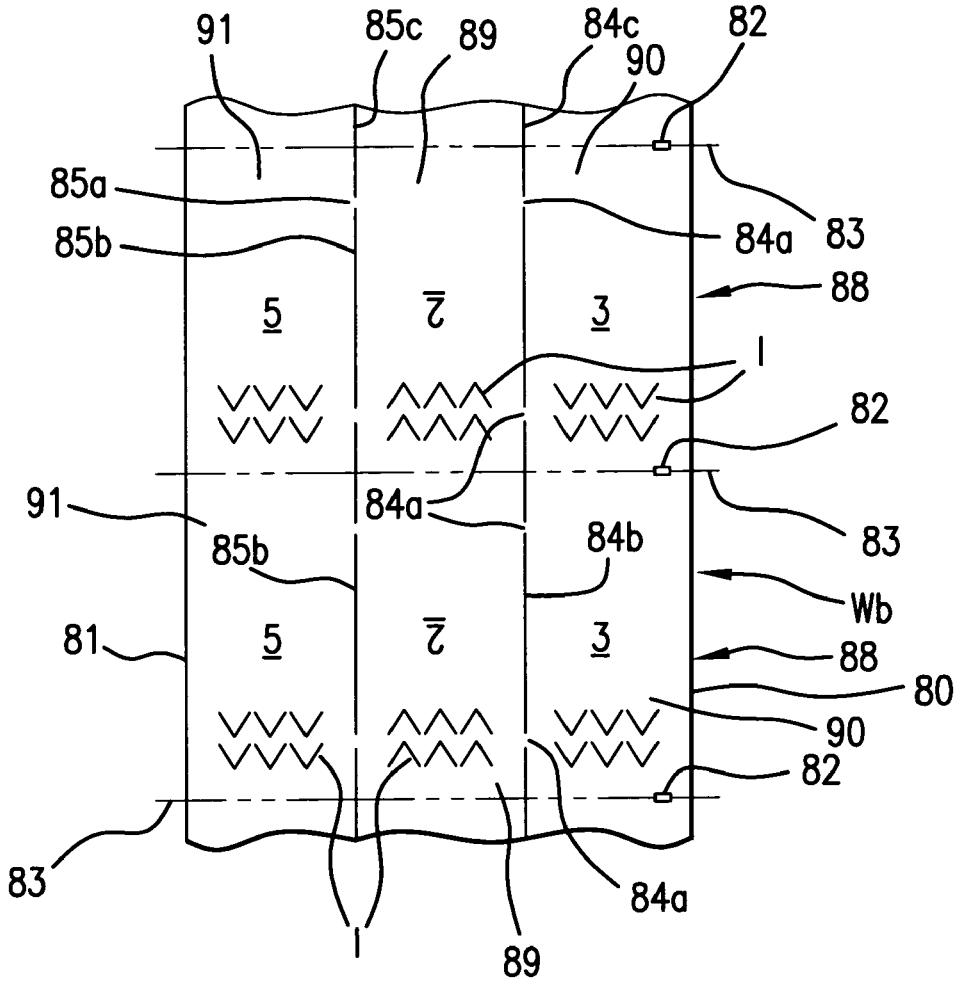
Figure 25:
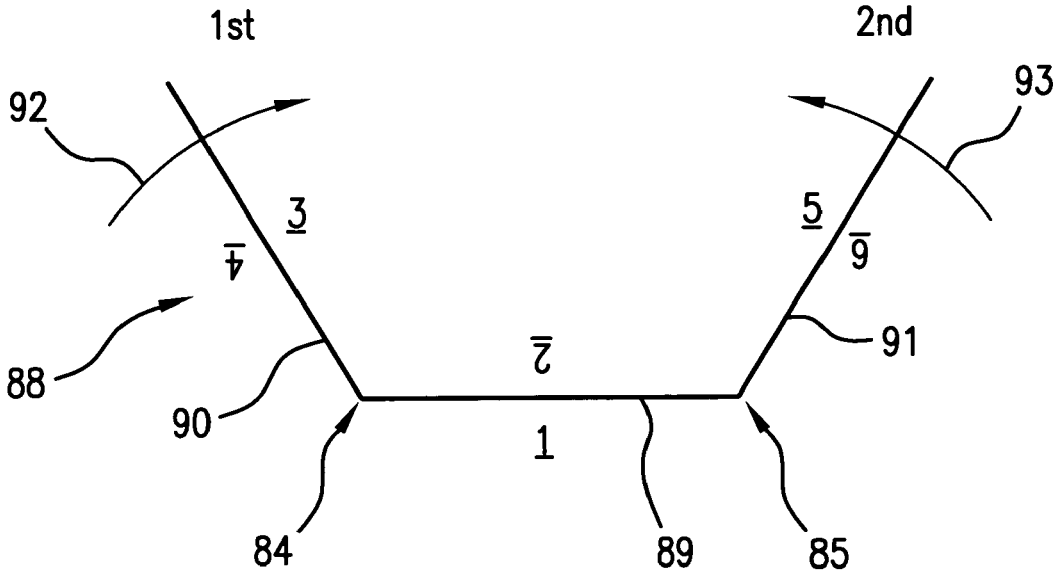
Figure 26:
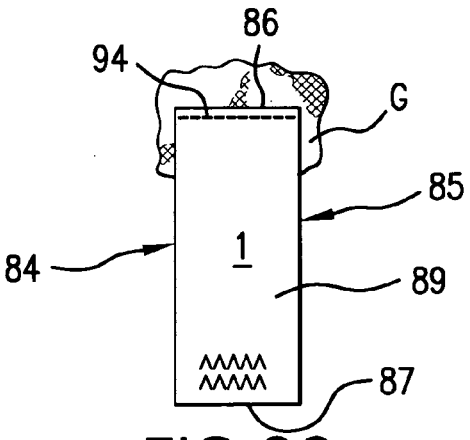
Figure 27:
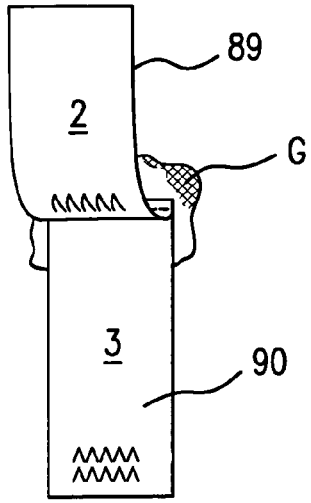
Figure 28:
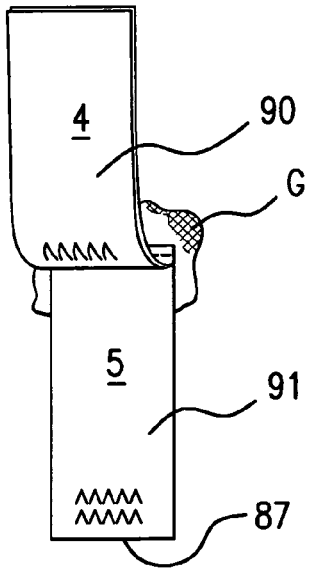
Figure 29:
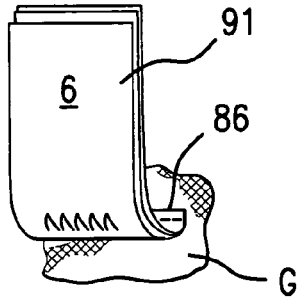
Figure 30:
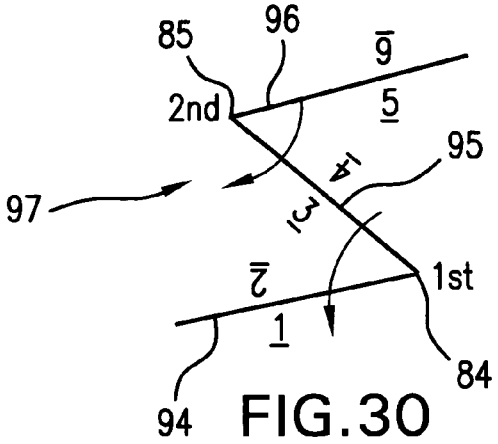
Figure 31:
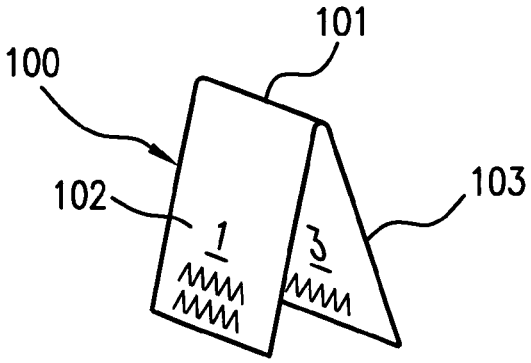
PRIOR ART FIG.31
Figure 32:
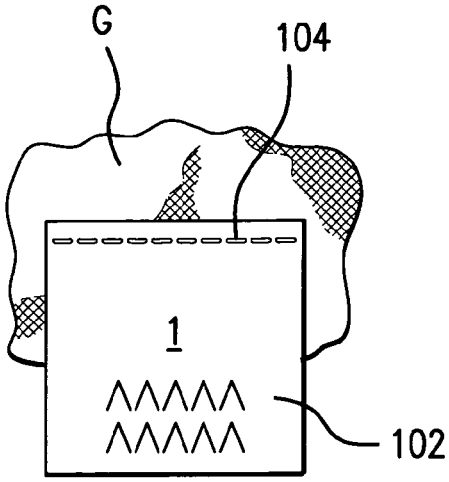
PRIOR ART FIG.32
Figure 33:
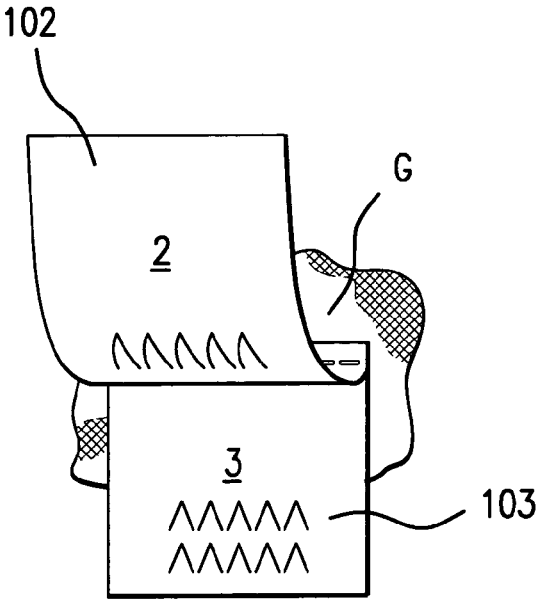
PRIOR ART FIG.33
Figure 34:
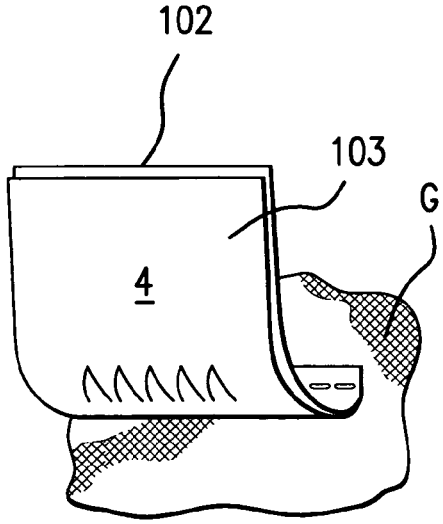
PRIOR ART FIG.34

FIG. 11 is a view similar to FIGS. 9 and 10, but showing the outermost label and the first underlying label folded up to expose side 4 of the first underlying label and side 5 of the second underlying label;

FIG. 12 is a view similar to FIGS. 9 through 11 with the outermost label and the two underlying labels folded up to expose side 6 of the underlying labels and side 7 of the third underlying label;

FIG. 13 is a view similar to FIGS. 9 through 12 with all the labels folded up to expose side 8 of the third underlying label;

FIG. 14 is a top plan view of an alternative embodiment of a web that has been printed in the printer of FIG. 1;

FIG. 15 is a bottom plan view of the web shown in FIG. 14;

FIG. 16 is a top plan view of one label array of FIGS. 14 and 15 that has been severed from the remainder of the web;

FIG. 17 is a bottom plan view of the label array of FIG. 16;

FIG. 18 is an enlarged pictorial view of the label array shown in FIGS. 16 and 17, partially folded;

FIG. 19 is a view of a completely folded label array as viewed toward the right side of FIG. 18;

FIG. 20 is a front elevational view of the label array shown in FIGS. 16 through 19 showing side 1 of the label array;

FIG. 21 is a view similar to FIG. 20, but showing the outermost label folded up to expose its side 2 and side 3 of the underlying label;

FIG. 22 is a view similar to FIGS. 20 and 21, but showing the outermost label and the underlying label folded up to expose side 4 of the underlying label;

FIG. 23 is a top elevational view of yet another embodiment of a web that has been printed in a printer such as the printer depicted in FIG. 1;

FIG. 24 is a bottom plan view of the web shown in FIG. 23;

FIG. 25 is a developing view showing the manner in which the label array is folded to form face-to-face labels that are to be attached to a garment;

FIG. 26 is a front elevational view of the label array shown in FIGS. 23 through 25, showing side 1 of the label array;

FIG. 27 is a view similar to FIG. 26, but showing the outermost label folded up to expose its side 2 and side 3 of the underlying label;

FIG. 28 is a view similar to FIGS. 26 and 27, but showing the outermost and the first underlying labels as folded up to expose side 4 of the first underlying label and side 5 of the second underlying label;

FIG. 29 is a view similar to FIGS. 26 through 28, but showing the outermost label and the first and second underlying labels folded up to expose side 6 of the second-underlying label;

FIG. 30 is an alternative arrangement for folding a label web similar to the one shown in FIGS. 23 and 24;

FIG. 31 is a pictorial view of a prior art label array partially folded and showing sides 1 and 3;

FIG. 32 is a front elevational view of the prior art label array of FIG. 31 sewn onto a garment;

FIG. 33 is a view similar to FIG. 32, but showing the outermost label folded up to expose side 2 of the outermost label and side 3 of the underlying label; and FIG. 34 is a view similar to FIGS. 32 and 33, but showing both labels folded up to expose side 4 of the underlying label.

DETAILED DESCRIPTION OF THE PREFERRED EMBODIMENTS

With reference initially to FIG. 1 which applies to the embodiments of FIGS. 2 through 30, there is shown a thermal printer generally indicated at 50 including thermal print heads 51 and 52 cooperable at printing positions with respective platen rolls 53 and 54 to print on lower and upper side or faces L and U respectively of a web generally indicated at W. Ink ribbons 55 and 56 drawn across respective print heads 51 and 52 are used to transfer ink to the respective lower and upper faces L and U of the web W. Cooperating knives 57 and 58 are used to cut sets or arrays of labels from the web W. As shown, the web W moves in the direction of arrow 59 and the ink ribbons 55 and 56 move in the direction of arrows 60 and 61 during printing. Although a thermal printer 50 is illustrated, any other suitable printer such as an ink jet printer, a flexographic printer or an offset printer can be used instead of a thermal printer. A commercial embodiment of a printer that can be used is disclosed in U.S. Pat. No. 7,125,182.

Figure 2:
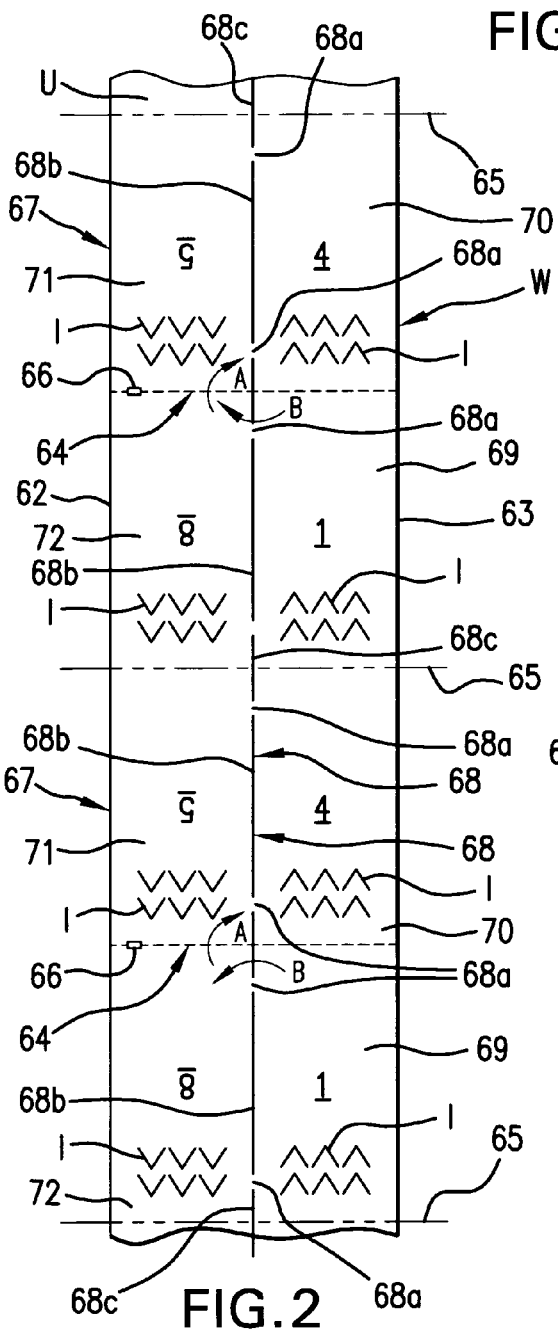
FIG. 2 is a top plan view of an embodiment of a web that has been printed in the printer such as the printer depicted in FIG. 1.
Figure 3:
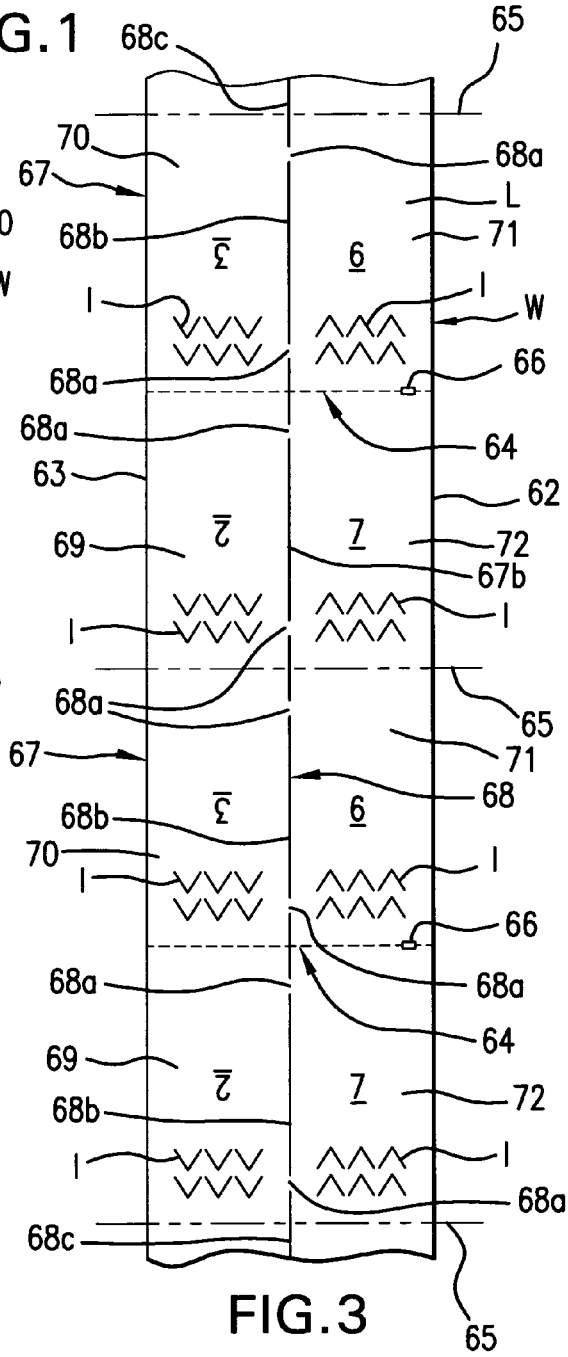
FIG. 3 is a bottom plan view of the web shown in FIG. 2.

With reference to the embodiment of FIGS. 2 through 13, and initially to FIGS. 2 and 3, there is shown a web W of printable fabric which have been printed with information I. Throughout, information that is printed right-side-up is indicated with an up arrow or an inverted "V" and information which is printed right-side-down is indicated with a down arrow or a "V". Information I which is printed right-side-up can be read in the usual way from top to bottom, and information I which is printed right-side-down can best be read from top-to-bottom when it is turned upside down.

The longitudinally extending web W is shown to have spaced, preferably parallel, longitudinally extending side edges 62 and 63. Longitudinally spaced transverse lines of weakening or partial severing generally indicated at 64 are preferably made at equally spaced apart intervals and preferably midway between adjacent lines indicated at 65 where severing can occur, although as shown in FIGS. 2 and 3 there is no severing of the web W along those lines. However, the lines 65 are nevertheless referred to herein as lines of severing. Partial severing or weakening 64 can be made by perforation cuts as shown, or by scoring, embossing, crushing or any other upsetting of the fabric which can make it easier to fold the fabric. The lines 65 show where the web W can be cut by knives 57 and 58 for example. There could be registration elements along the cut lines, but in the present embodiment it is preferred to have printed registration elements 66 at the lines of weakening 64. The registration elements 66 can be cutouts or holes as shown or they can be printed marks or notches, for example.

FIGS. 2 and 3 each show two complete sets or arrays generally indicated at 76. FIG. 2 shows the upper side or face U and FIG. 3 shows the lower side or under face L of the web W. The areas between adjacent lines of severing 65 indicate one label set or array 67. A longitudinally line of partial severing or weakening 68 is shown midway between side edges 62 and 63, as is preferred. The line of weakening 68 may be comprised of uncut or frangible or severably portions 68*a* and completely cut portions 68*b* and 68*c* between two side-by-side pairs of labels of the array 67. In that the lines of weakening 64 are shown midway between cut lines 65, as is preferred, each label set or array has four equal size labels 69, 70, 71 and 72. However, the lines of weakening 64 can be at other than midway between adjacent cut lines 65, if desired. Accordingly, the labels of the array would be of different sizes. With reference to FIG. 2, labels 67 through 72 on the upper face U are shown to have sides: 1, 4, inverted 5 and inverted 8. With reference to FIG. 3, the labels 69 through 72 on the lower face L are shown to have sides: inverted 2, inverted 3, 6 and 7.

Figure 4:
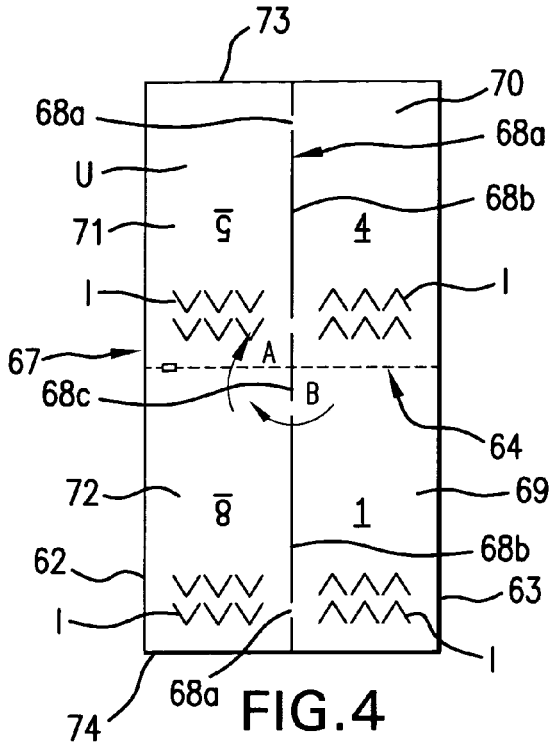
FIG. 4 is a top plan view showing one label array of FIGS. 2 and 3 that has been severed from the remainder of the web.
Figure 5:
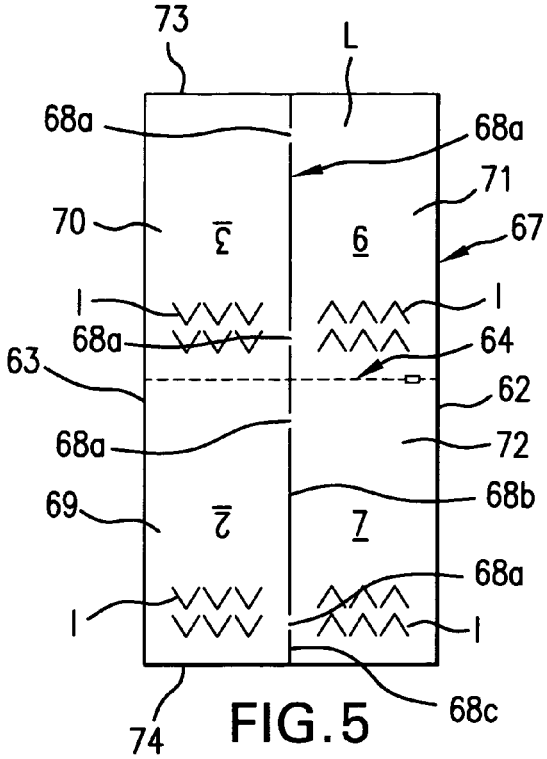
FIG. 5 is a bottom plan view of the label array of FIG. 4.

FIGS. 4 and 5 show one label set or array 67 as having been cut from the web W. The cut ends of an array are indicated at 73 and 74.

Figure 6:
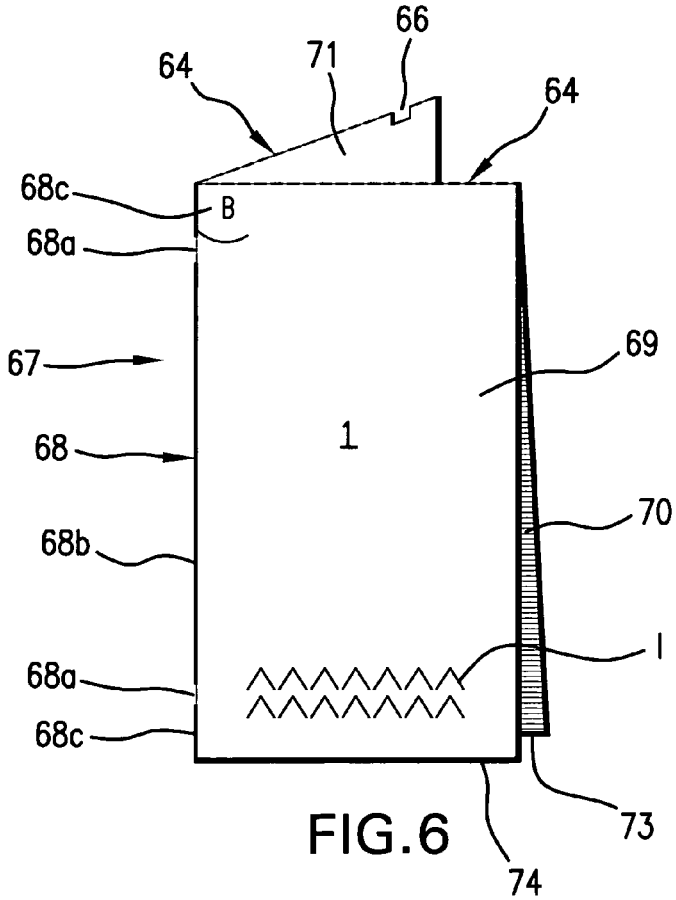
FIG. 6 is a pictorial view showing the label array as having been folded about a line of partial severing or weakening and partially folded about another fold line of partial severing or weakening.
Figure 7:
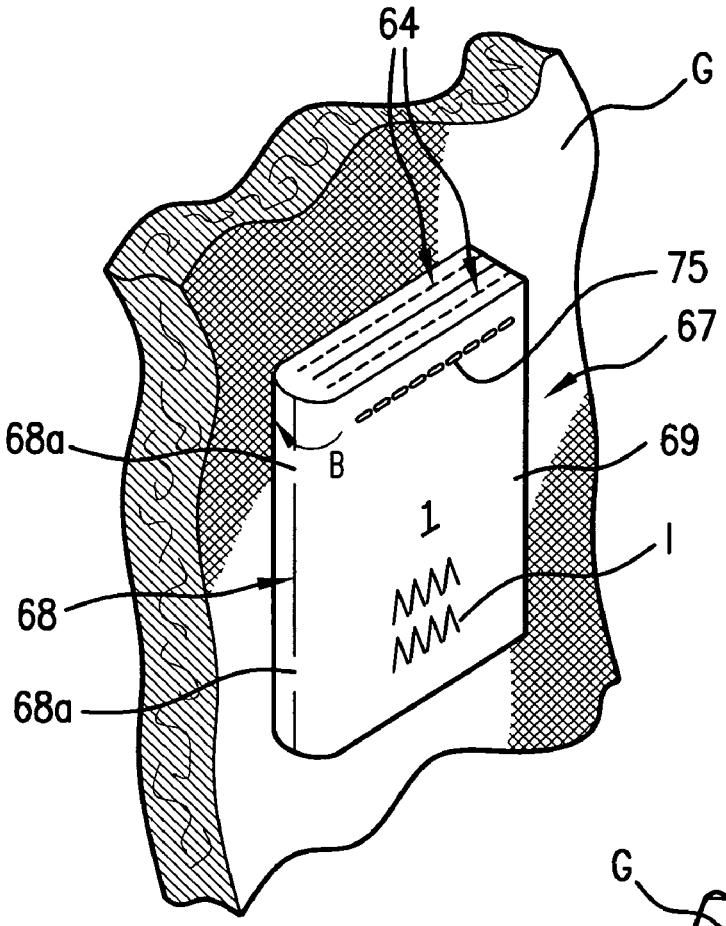
FIG. 7 is a pictorial view of the label array attached to an article such as a garment.
Figure 8:
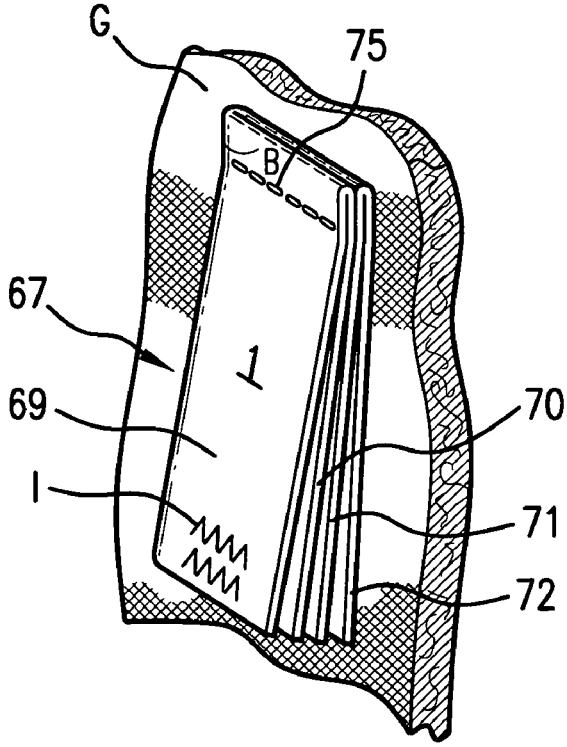
FIG. 8 is another pictorial view of the label array attached to the garment.

FIG. 6 shows the label array 67 partial folded. The array 67 is first folded about line of weakening 64 and thereafter about line of weakening 68. The fully folded array 67 shown in FIGS. 7 and 8 attached to an article such as a fabric garment G. FIG. 7 is viewed generally from the left side of FIG. 6, while FIG. 8 is viewed from the right side of FIG. 6. The label array 67 can be attached by sewing or stitching through the array 67 and the garment G as indicated at 75 or adhesively.

FIGS. 9 through 13 show the manner or organization of the printing on the upper and lower faces or sides U and L respectively of the folded array 67, so that when the array 67 is folded all sides 1 through 8 are readable from top-to-bottom. In FIG. 9, side 1 of the outermost label 69 is readable from top-to-bottom. In FIG. 10, once frangible or severable portions 68*a* between the labels 69 and 72 have been fractured or broken, as by using a finger inserted between adjacent labels 69 and 70, the label 69 can be folded up to the position shown so that both the information on side 2 of label 69 and side 3 of label 70 can be read from top-to-bottom. In FIG. 11, once the frangible portions 68*a* between side edges of the labels 70 and 71 has been broken, the label 71 can be folded up as shown and both the information on side 4 of the label 70 and the information on side 5 of the label 71 can be read from top-to-bottom. In FIG. 12, the label 71 can be folded up and the side 6 of the label 71 and the side 7 of the label 72 can be read from top-to-bottom. In FIG. 13, once the label 72 has been folded up, the side 8 of the label 72 can be read from top-to-bottom. It can be seen that the label array 67 can be cut from the web W and folded to make four labels 69 through 72 with eight sides 1 through 8, and yet all the labels are readable from top-to-bottom. In order to achieve all the benefits of this arrangement some of the printing of information I along the web W must extend in one direction and other of the information must extend in the opposite direction on both faces U and L. Thus, when the array 67 is attached to an article such as a garment G, all the information I can be read from top-to-bottom. In that all the labels 69 through 72 of the array 67 preferably remain connected at least until the array 67 is ready to be attached to the garment G, there cannot be a mixup or interchange of the labels 69 through 72 that belong to one set or array 67 with those labels that belong to another set, nor can there be a mixup as to the correct orientation of the various labels 69 through 72 with respect to each other. The label web of each of the embodiments disclosed herein is preferably comprised of a coated, woven or non-woven, polyester or acetate or other synthetic material that can be readily broken or cut manually at the frangible portions 68*a* for example. Thus, it is a simple matter to tear the labels 69 through 72 for example, apart should it be desired to read information on the underside of the outermost label 69 or any of the first, second and third underlying labels. It should be noted that each label preferably has at least one frangible portion connecting it to an adjacent label transverse thereto, but more than two frangible portions per label can be used. Also, it is not necessary that all the labels in any disclosed array, such as the array 67, need be printed on both sides.

FIGS. 2, 4 and 6 show indicia preferably printed on the array 67 in the form of an "A" and a "B" with respective arrows. The letters "A" and "B" are a guide, reference or aid to the person who folds the array 67 to firstly fold the array 67 about line of weakening 64 and to secondly fold the array 67 about the line of weakening or fold line 68. These indicia are meaningful to the person who folds the array 67 to show the sequence in which the array is to be folded but are irrelevant to the user of the garment. Other indicia such as a "1" and a "2" could be used instead of "A" and "B" or the indicia would be in other languages. The indicia are omitted from small figures, namely, FIGS. 9 through 13 for clarity. Such indicia can also be used in connection with the embodiment of FIGS. 23 through 29, and in the embodiment of FIG. 30 for the same purpose, if desired.

The embodiment of FIGS. 14 through 22 comprises a web generally indicated at Wa that can be cut into label arrays along cut lines 65*a*. The cut lines 65*a* are shown to pass through registration elements 66*a* which can be holes like the registration elements 66. The web Wa has side edges 62*a* and 63*a*. A longitudinally extending frangible line of partial severing or weakening generally indicated at 68' is shown to be comprised of cut lines 68*b'* and 68*c'* spaced by uncut frangible or severably portions or lands 68*a"*. Upper face U of each label array 67*a* has sides 1 and 4 of labels 76 and 77 and lower face L of each label array 67*a* has sides 2 and 3 of labels 76 and 77. As is preferred, the frangible line of weakening 68' is midway between side edges 62*a* and 63*a* so that labels 76 and 77 are of equal size.

FIGS. 16 and 17 show the label array 67*a* as having been severed from the web Wa. The cuts at the cut lines 65*a* form ends 78 and 79. FIG. 18 shows the label array or composite label 67*a* as partially folded about frangible line of weakening 68' to partially expose side 3 of label 77. FIG. 19 shows the label array attached to the garment G, as by stitching 75' along line 75".

FIGS. 20 through 22 show that the disclosed arrangement results in all of the sides 1 through 4 of the label array 67*a* being readable from top-to-bottom once the labels 76 and 77 are separated along line 68'. In FIG. 20, the information I on side 1 of the outer label 76 is readable from top-to-bottom. In FIG. 21, the outer label 76 has been folded up to expose printed information I on side 2 and printed information I on side 3 of the label 77. In FIG. 22, both labels 76 and 77 have been folded up to expose information I on side 4 of the label 77.

In the embodiment of FIGS. 23 through 29, there is disclosed a web Wb having spaced apart parallel side edges 80 and 81 extending in the longitudinal direction. The web Wb can have registration elements 82 at longitudinally spaced locations. The registration elements 82 are shown to lie along the lines 83 at which complete severing can occur. There are two longitudinally extending frangible, parallel lines of partial severing generally indicated at 84 and 85 spaced between the side edges 80 and 81. The line 84 and the side edge 80, the lines 84 and 85, and the line 85 and the side edge 81 are preferably equally spaced and parallel so that the labels 89, 90 and 91 have the same width and size. The lines 84 and 85 have respective completely severed portions 84*b* and 84*c* and 85*b* and 85*c*. When the web Wb is cut or severed along lines 83, the cut makes the ends 86 and 87 of the label array 88 as shown in FIG. 26 for example. Each label array 88 is comprised of connected labels 89, 90 and 91. When a label array or set 88 has been cut from the web Wb, the label 90 is folded about line 84 relative to the label 89 in the direction of arrow 92 until the labels 89 and 90 are face-to-face. Thereafter, the label 91 is folded about line 85 relative to the label 89 in the direction of arrow 93 until the label 91 is face-to-face with the label 90. In this folded condition, the label array 88 can be attached to an article such as a garment G as shown in FIG. 26, for example, as for example by sewing 94. When the frangible or severable portions or lands 84*a* and 85*a* are torn or cut, then the label 89 can be folded up to expose side 2 of the label 89 and side 3 of the label 90 as shown in FIG. 27. When the label 90 is also folded up as shown in FIG. 28, the side 4 of the label 90 and the side 5 of the label 91 are exposed. When also the label 91 is folded up as shown in FIG. 29, the side 6 of the label 29 is exposed.

The embodiment of FIG. 30 is the same as the embodiment of FIGS. 23 through 29, except that the label array 97 is folded according to an inverted "Z" pattern as shown in FIG. 30 and also the arrangement of the printing on labels 94, 95 and 96 of the label array 97 needs to be different than in the embodiment of FIGS. 23 through 29 so that all of the information I is readable from top-to-bottom. In folding the label array 97, the label 95 can first be folded about line of weakening 84 relative to the label 94 until the label 95 is face-to-face and parallel to the label 94. Second, the label 96 can be folded about line of weakening 85 until the label 96 is face-to-face and parallel to the label 95. When thus folded, the label array 97 can be attached to the garment G.

With reference to the prior art of FIGS. 31 through 34, a long label array 100 is folded about a fold line 101 to provide labels 102 and 103. Alternatively, the labels 101 and 103 can be separate but nevertheless sewn to the garment G as indicated at 104. Alternatively, more than two folded labels 102 and 103 or more than two separate labels can be sewn together onto the garment, but there is no way to assure that separate labels are correctly associated or oriented.

FIG. 33 shows side 2 of label 102 and side 3 of label 103 exposed by folding the label 102 up. FIG. 34 shows both labels 102 and 103 folded up to expose side 4 of the label 103.

In the various embodiments, the frangible lines 68, 68*a*' 68', 84 and 85 are preferably perpendicular to respective lines 65, 65*a*, and 83. All the frangible lines 68, 68*a*' 68', 84 and 85 are preferably parallel to respective side edges 62, 63, 62*a*, 63*a*, 80 and 81. The lines 65, 65*a* and 83 of each web are preferably parallel to each other.

In all the disclosed embodiments, the labels are capable of undergoing repeated washings and/or dry cleanings.

Side edges of the webs W, Wa and Wb are preferably straight. The labels of each set or array are preferably rectangular and preferably the same size, and preferably longer in the direction away from the place the label array is attached, however, the labels can be of different sizes.

While the frangible or severable portions of the various disclosed embodiments are severable by hand, alternatively a knife blade could be used, if desired.

Other embodiments and modifications of the invention will suggest themselves to those skilled in the art, and all such of these as come within the spirit of this invention are included within its scope as best defined by the appended claims.

I claim:

1. Labeling method, comprising:

providing a longitudinally extending web of printable fabric label material having opposite faces and bounded by longitudinally extending side edges, the web having at least one longitudinally extending frangible line of partial severing spaced between the side edges to provide repetitive sets of at least two labels, printing information on one face of the web on at least most of the labels of each set and on the other face of the web on at least one of the labels of each set, the labels being capable of undergoing repeated washings and/or dry cleanings;

folding the labels relative to each other to provide a folded label array of at least two frangibly connected, printed labels; and severing the web along transverse lines between sets to provide two or more printed labels frangibly connected at the partial severing.

2. Method as defined in claim 1, further comprising:

attaching the label array to a garment.

3. Method as defined in claim 2, further comprising:

separating at least two labels of the array at the partial severing after the array has been attached to the garment.

4. Method as defined in claim 1, wherein the label array is folded twice.

5. Method as defined in claim 1, including partially severing the web along transverse lines to provide fold lines between the lines of transverse severing.

6. Method as defined in claim 1, further comprising:

partially severing the web along a transverse line between longitudinally spaced ends of each set to provide at least four foldably connected printed labels.

7. Method as defined in claim 6, further comprising:

attaching the label array to a garment.

8. Method as defined in claim 1, wherein some of the printed information on one face is printed right-side-up and other of the printed information on the one face is printed right-side-down in the longitudinal direction.

9. Method as defined in claim 8, wherein some of the printed information on the other face is right-side-up and other of the printed information on the other face is right-side-down in a longitudinal direction.

10. Method as defined in claim 1, wherein some of the printed information on the other face is right-side-up and other of the printed information on the other face is right-side-down in the longitudinal direction.

11. Labeling method, comprising:

providing a label array of at least three printed labels, connected along at least two frangible lines, the printed labels being capable of undergoing repeated washings and/or dry cleanings, folding the labels along the frangible lines into face-to-face relationship, and attaching the printed label array of frangibly connected labels to a garment.

12. Labeling method as defined in claim 11, further comprising:

thereafter separating at least some of the labels from each other along the frangible line.

13. Labeling method as defined in claim 11, further comprising:

wherein each label has outer and under faces, wherein some of the printing on the outer face is right-side-up and some of the printing on the under face is right-side-down.

14. A web of labels, comprising:

a longitudinally extending web of printable fabric label material having opposite faces and bounded by longitudinally extending side edges, the fabric material being capable of undergoing repeated washings and/or dry cleanings, the web having at least one longitudinally extending frangible line of partial severing spaced between the side edges to divide the web into sets of at least two foldably and frangibly connected labels, and printed information on both faces of the labels of each set and the fabric material has outer and under faces, wherein some of the printed information on the outer face is right-side-up and some of the printing on the under face is right-side-down.

15. A web of labels as defined in claim 14, further comprising:

registration elements along the web.

16. A web of labels as defined in claim 14, further comprising:

transverse lines of weakening to provide fold lines at longitudinally spaced intervals between the ends of each set.

17. A web of labels as defined in claim 16, further comprising:

registration elements along the web, and transverse lines of weakening to provide fold lines at longitudinally spaced intervals at the transition between sets.

18. A label array capable of being attached to a garment, comprising:

a set of at least two frangibly connected labels comprised of fabric material and capable of undergoing repeated washings or dry cleanings, each label having an outer face and an under face, printed information on both faces of at least one of the labels, printed information on at least one face of the other label(s), the printed information being arranged so that any printing on the outer face of each label is right-side-up and so that any printing on the under face of each label is right-side-down.

19. A label array as defined in claim 18, wherein the array comprises four labels, wherein the array is folded along two fold lines.

20. A label array as defined in claim 18, wherein the labels are frangibly connected at side edges thereof.

21. A label array as defined in claim 18, including indicia to indicate the sequence in which the array is to be folded.

22. Labeling method, comprising:

printing an array of at least two generally planar, frangibly connected, labels having a face in a single printer, wherein some of the printing on one face is printed right-side-up and other of the printing on the one face is printed right-side-down in the longitudinal direction;

folding the labels relative to each other into a folded array, and attaching the folded array to a garment.

* * * * *